US007750860B2

(12) United States Patent
Mohamadi

(10) Patent No.: US 7,750,860 B2
(45) Date of Patent: Jul. 6, 2010

(54) HELMET ANTENNA ARRAY SYSTEM

(76) Inventor: Farrokh Mohamadi, 8 Halley, Irvine, CA (US) 92612-3797

( * ) Notice: Subject to any disclaimer, the term of this patent is extended or adjusted under 35 U.S.C. 154(b) by 725 days.

(21) Appl. No.: 11/470,720

(22) Filed: Sep. 7, 2006

(65) Prior Publication Data

US 2010/0134365 A1 Jun. 3, 2010

(51) Int. Cl.
*H01Q 1/12* (2006.01)
*H01Q 3/24* (2006.01)

(52) U.S. Cl. ..... 343/718; 343/841; 343/876; 343/792.5

(58) Field of Classification Search ..... None
See application file for complete search history.

(56) References Cited

U.S. PATENT DOCUMENTS

| | | | | |
|---|---|---|---|---|
| 5,815,120 | A * | 9/1998 | Lawrence et al. | 343/702 |
| 6,356,773 | B1 * | 3/2002 | Rinot | 455/575.1 |
| 6,677,913 | B2 * | 1/2004 | Engargiola et al. | 343/792.5 |
| 7,349,701 | B2 * | 3/2008 | Lastinger et al. | 455/446 |
| 2004/0155725 | A1 * | 8/2004 | Kwiatkowski | 333/101 |
| 2004/0180691 | A1 * | 9/2004 | Cascone | 455/557 |
| 2005/0107125 | A1 * | 5/2005 | Gilbert | 455/562.1 |
| 2006/0022882 | A1 * | 2/2006 | Gerder et al. | 343/718 |

OTHER PUBLICATIONS

R.C Adams et al., COMWIN Antenna System Fiscal Year 2000 Report, Technical Report 1836, Sep. 2000, San Diego, California.

R.C Adams, The COMWIN Antenna Project, SPAWAR Systems Center, 2000, San Diego, California.

A. Andrews et al., Research on Ground-Penetrating Radar for Detection of Mines and Unexploded Ordinance: Current Status and Research Strategy, IDA Document D-2416, Dec. 1999.

G.L. Duckworth, Fixed and Wearable Acoustic Counter-Sniper Systems for Law Enforcement, SPIE International Symposium on Enabling Technologies for Law Enforcement, Nov. 1998.

J. Gavan et al., Transmitters Interference to Victim Receivers and Radiation Hazard to Humans: Are They Correlated?, Toronto URSI General Assembly, Aug. 1999.

IEEE Standards Coordinating Committee 28, IEEE/ANSI Standard for Safety Levels with Respect to Human Exposure to Radio Frequency Electromagnetic Fields, 1999, NY.

N.B. Leonard, K.R. Foster, and T.W. Athey, Thermal Properties of Tissue Equivalent Phantom Materials, IEEE Transaction on Biomedical Engineering, Jul. 1984, vol. BME-31.

F. Mohamadi., A Proposed Completely Electronically Controlled Beamforming Technology for Coverage Enhancement, IEEE P802.15, Mar. 2005, Atlanta, GA.

J.M. Ziriax et al., Assessment of Potential Radiation Hazard from the COMWIN Vest Antenna, Technical Report, 2003, Brooks City-Base, Texas.

* cited by examiner

*Primary Examiner*—Trinh V Dinh
(74) *Attorney, Agent, or Firm*—Haynes & Boone, LLP.

(57) ABSTRACT

A helmet substrate is covered with a highly absorptive layer and an antenna layer. The antenna layer includes a conformal log periodic dipole array wherein adjacent antenna elements connect through switches. By driving appropriate ones of the switches, the log periodic dipole array tunes to a desired frequency band.

4 Claims, 5 Drawing Sheets

HELMET ANTENNA ARRAY SYSTEM

TECHNICAL FIELD

The present invention relates generally to antennas, and more particularly to a helmet-integrated broadband antenna array.

BACKGROUND

Helmets provide vital protection in numerous applications such as for members of the military, fire crews, police, and heavy industry. Because wireless communication is also essential, helmets provide a natural mounting location for the associated antennas because a helmet will be at the highest mounting point available on a human being. However, a projecting antenna in military applications increases a soldier's visual signature and thus increases the danger of sniper fire. Conformal antennas that do not project from a helmet tend to be quite narrowband, which interferes with defense objectives such as the Joint Tactical Radio System, which requires connectivity across a large bandwidth. Other concerns include the size and weight of the antenna, the antenna connection to the torso (assuming that the radio transceiver is carried on the torso), as well as heath issues resulting from the RF radiation. In addition, electromagnetic interference/electromagnetic compatibility (EMI/EMC) issues must also be considered for helmet-integrated antennas.

Given the concerns raised by helmet-integrated antennas, current military wireless applications have settled on body-mounted antennas. However, a body-mounted antenna will tend to interfere with other gear worn by a soldier. In addition, a body-mounted antenna will tend to be more obstructed such as when a soldier is in a foxhole or in a prone position. In contrast, a helmet-integrated antenna has the advantage of a higher, more rigid and stable mounting platform.

Accordingly, there is a need in the art for conformal helmet-integrated antennas offering high bandwidth and low RF radiation.

SUMMARY

In accordance with one aspect of the invention, a helmet antenna array system (HAAS) is provided that includes: a helmet substrate covered by a metallic shield layer; an RF absorptive layer on the metallic shield layer, an antenna layer over the RF absorptive layer; and a low-dielectric layer on the antenna layer.

In accordance with another aspect of the invention, a method is provided that includes the acts of: providing a helmet including a conformal log periodic dipole array arranged on a helmet substrate wherein adjacent dipoles in the array couple through switches; selecting respective ones of the dipoles in the array through activation of corresponding respective ones of the switches; and receiving an RF signal from the selected dipoles.

In accordance with another aspect of the invention, a helmet antenna array system (HAAS) is provided that includes a conformal log periodic dipole array on a helmet substrate, wherein each dipole includes first and a second antenna elements, and wherein adjacent dipoles in the array couple through switches such that a first antenna element in a first one of the dipoles selectably connects to a second antenna element in a second one of the dipoles, and a second antenna element in the first one of the dipoles selectably connects to a first antenna element in the second one of the dipoles, and so on.

The invention will be more fully understood upon consideration of the following detailed description, taken together with the accompanying drawings.

DETAILED DESCRIPTION

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

Figure 1:
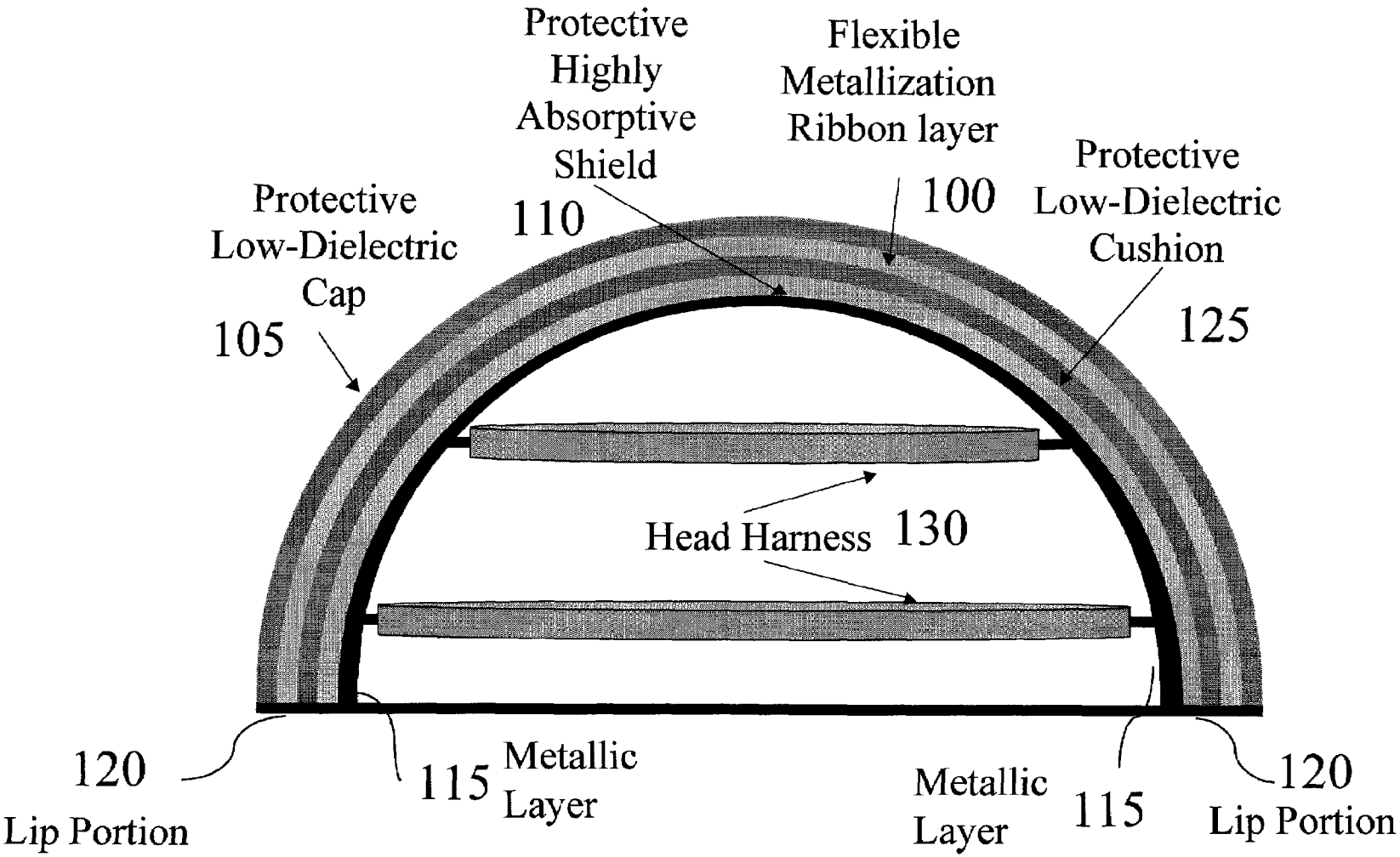
FIG. 1 is a cross-sectional view of an exemplary helmet antenna array system (HAAS).

The present invention provides a helmet-integrated antenna system that may be denoted as a helmet antenna array system (HAAS) having a programmable broadband capability. Turning now to FIG. 1, the HAAS may include four distinct layers. A flexible metallization layer 100 includes the antenna array. The flexible metallization layer is covered by a very low dielectric layer 105 such as a porous foam layer or a honeycombed low-density polymer layer. The flexible metallization layer covers a protective highly-absorptive shield layer 110 such as a sealed salt solution (e.g., NaCl) or a highly-absorptive plastic. Underneath the shield layer is a metallic layer 115 that may be grounded to the ground for the antennas' power supply (discussed further below). To provide extra protection, the metallic shield at the rim of the helmet may be extended to form a lip portion 120. metallic layer. A second low-dielectric layer 125 may separate the highly-absorptive shield layer from the antenna layer. The metallic layer may be formed by painting a composite forming the helmet substrate (not illustrated) with a metallic paint. The absorptive shield layer, optional second low-dielectric layer, the antenna layer, and the covering low-dielectric layer may be attached to the painted helmet substrate with Velcro, hooks, or other suitable means. The helmet is positioned on a wearer's head using a chin strap (not illustrated) and harness bands 130. Using the low-density materials described with regard to FIG. 1, the weight of layers 110 through 100 is as little as 2.0 grams, which is 50% less than Department of Defense (DOD) objectives. Moreover, the absorptive and metallic shield layers function such that no measurable field exists within the interior of the helmet and less than 1 milliwatt/cm$^2$ field strength exists around the lip portions.

In one embodiment, to provide the broad bandwidths necessary to satisfy DOD objectives (such as from 200 to 2500

Figure 2:
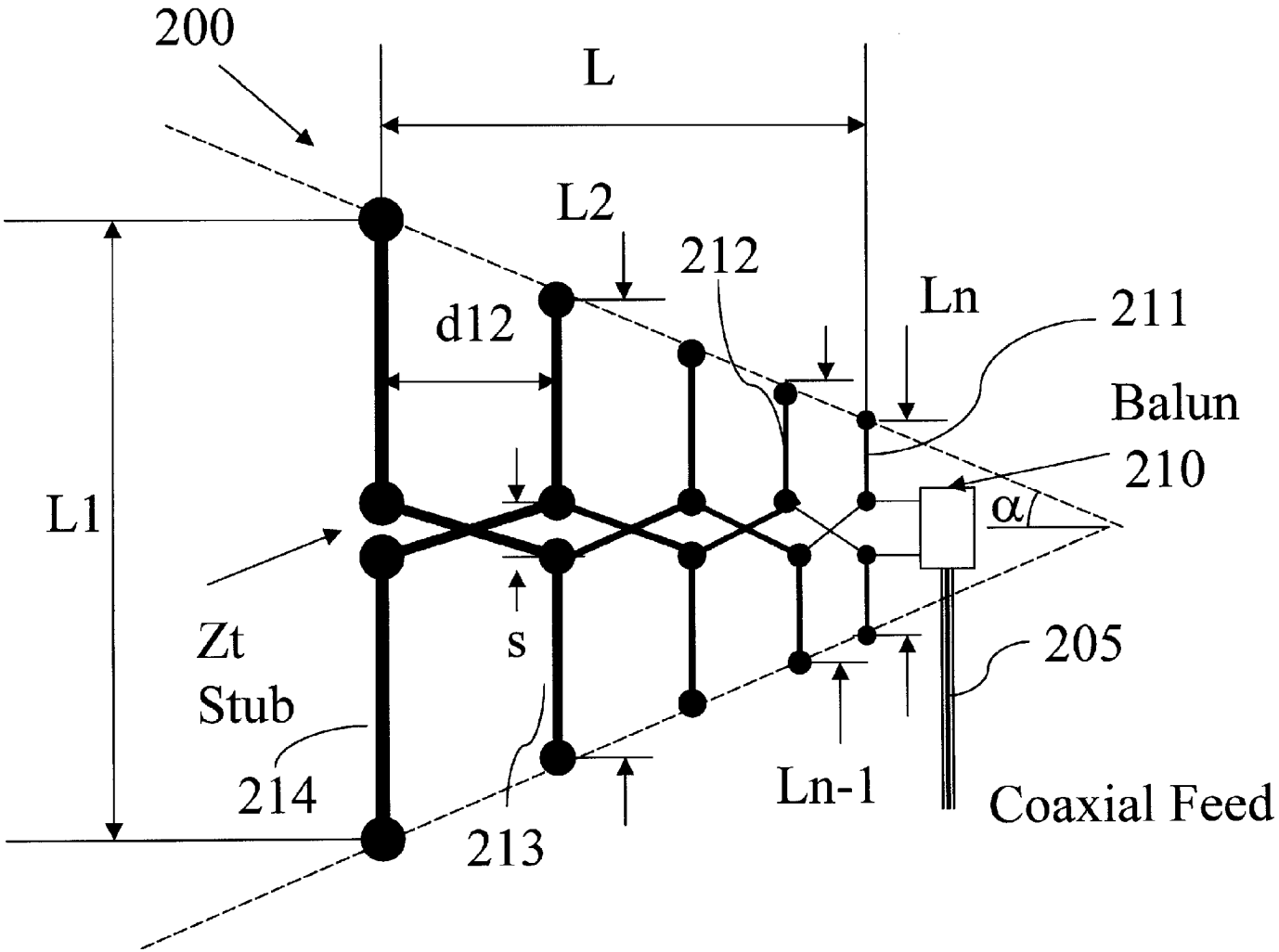
FIG. 2 is a schematic illustration of a log periodic dipole array for the HAAS of FIG. 1.

MHz), the antenna layer includes a log periodic dipole array (LPDA) 200 such as shown schematically in FIG. 2. Advantageously, an LPDA can be operated over a range of frequencies having a ratio of 2:1 or higher. Despite this broad range of frequencies, the LPDA's electrical characteristics such as gain, feed-point impedance, front-to-back ratio, and other factors will all remain substantially constant. Other multi-element antenna arrays typically will have significant variation of these parameters over an analogous bandwidth. Moreover, an LPDA is more resistant to off-resonant operation that causes variation of the standing wave ratio (SWR). LPDA 200 may provide a 1.3:1 SWR variation with respect to a 1.8:1 frequency variation with a typical directivity of 9.5 dB (directivity is the ratio of maximum radiation intensity in a preferred direction to the average radiation intensity from the array). Assuming no resistive losses in the antenna system, 9.5 dB directivity equates to 9.5 dB gain over an isotropic radiator or approximately 7.4 dB of gain over a half-wave dipole antenna. LPDA 200 may be fed with a coaxial feed 205 through a Balun 210. From the feedpoint at the Balun, the increasing lengths of successive dipole elements defines an angle $\alpha$. Each antenna element is driven with a phase shift of 180 degrees by alternating element connections between adjacent antenna elements. This phase shift along with the phase shift caused by the electrical length d between adjacent antenna elements will add to 360 degrees at the appropriate frequency. For example, the electrical length between the first two dipole antenna 211 and 212 may be such that, at a given frequency $f_0$, the radiation from these two dipoles is essentially out-of-phase such that these antennas cancel each other's radiation. However, the electrical separation d12 between the last two dipole elements 213 and 214 along with the 180 degree phase shift from the alternating connection may be such that dipoles 213 and 214 are essentially in-phase at the same frequency $f_0$. By increasing the feed frequency, another frequency $f_1$ may be found such that the 180 degree phase shift and the electrical length between antenna elements 211 and 212 brings these antennas in-phase with each other. The operating bandwidth for LPDA 200 would thus range from $f_0$ to $f_1$.

Figure 3A:
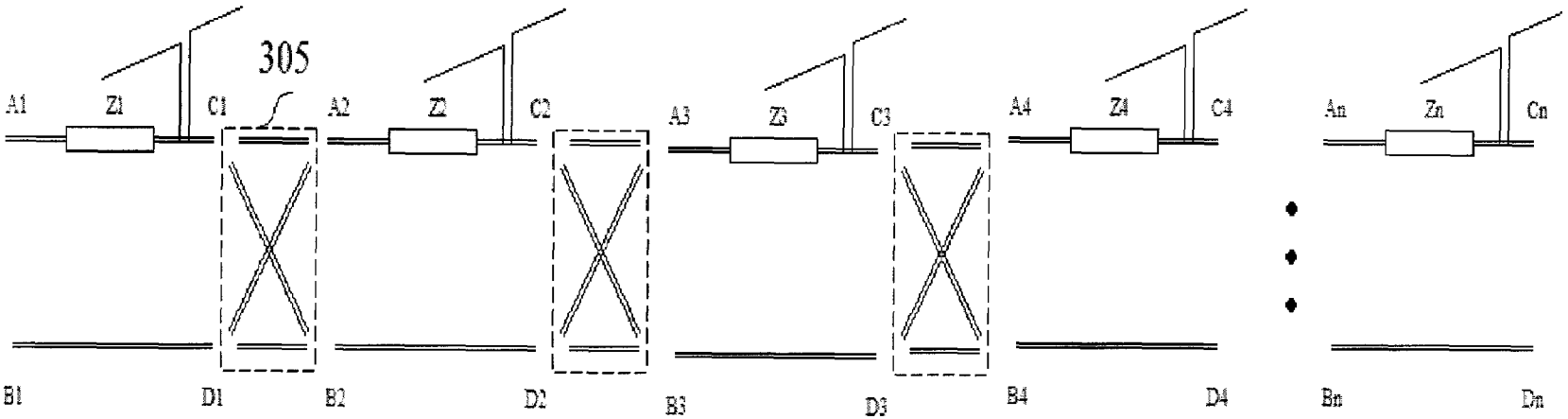
FIG. 3*a* is a conceptual illustration of a switch matrix for the log periodic dipole array of FIG. 2.
Figure 3B:
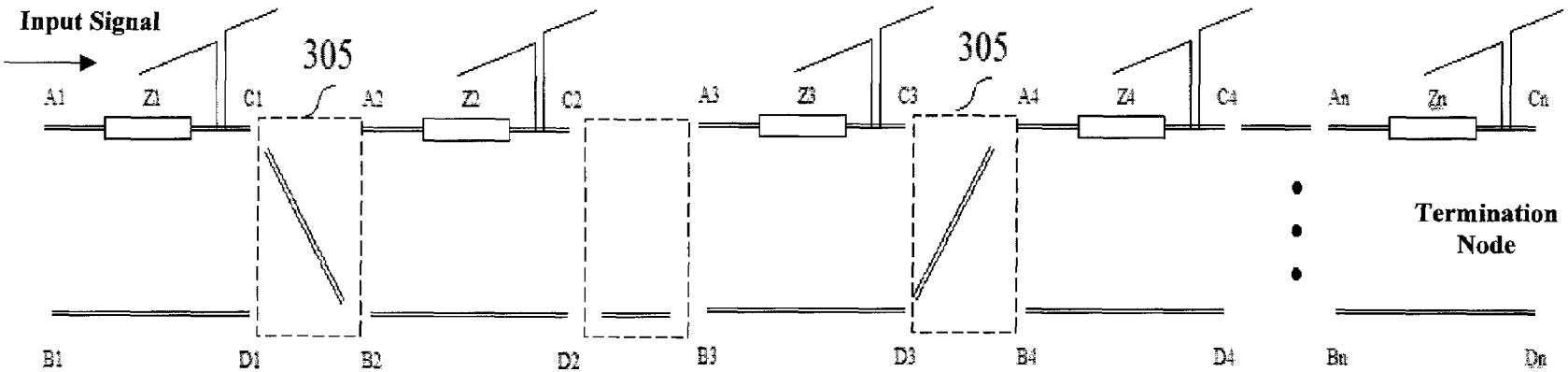
FIG. 3*b* illustrates a particular switching arrangement for the switch matrix of FIG. 3*a*.

To provide a programmable capability to select a certain sub-band of operation within the broadband of frequencies enabled by LPDA 200, a switching arrangement such as illustrated in FIG. 3*a* may be implemented. Each dipole antenna associates with a switch 305 and two input ports A and B and two output port C and D as well as a matching impedance Z. Each switch 305 couples between adjacent output ports C and D and input ports A and B between adjacent antenna elements. For example, a first switch 305 couples between output ports C1 and D1 and input ports A2 and B2. Each switch is configurable such that the C output may be connected to either of the adjacent A or B inputs. Similarly, the D output may be connected to either of the adjacent A or B inputs. In this fashion, a given antenna element may be connected to receive an input signal or to be bypassed by the input signal. For example, as seen in FIG. 3*b*, if output port C1 connects to input port B2 and output port D2 connects to input port B3, the second and third antenna elements do not receive the input signal. However, if output port D3 connects to input port B4, the fourth matching impedance element (represented by Z4) and the fourth antenna will receive the input signal. In this fashion, a user may dynamically control the bandwidth of the LPDA for a specific frequency use. For example, if the fourth antenna is electrically sized for reception in the GPS or DGPS band such as L1 or L2, the switching arrangement shown in FIG. 3*b* will select for the appropriate bandwidth. This unique switching arrangement enables low probability of detection by interrogating radars or signal sources.

Figure 4:
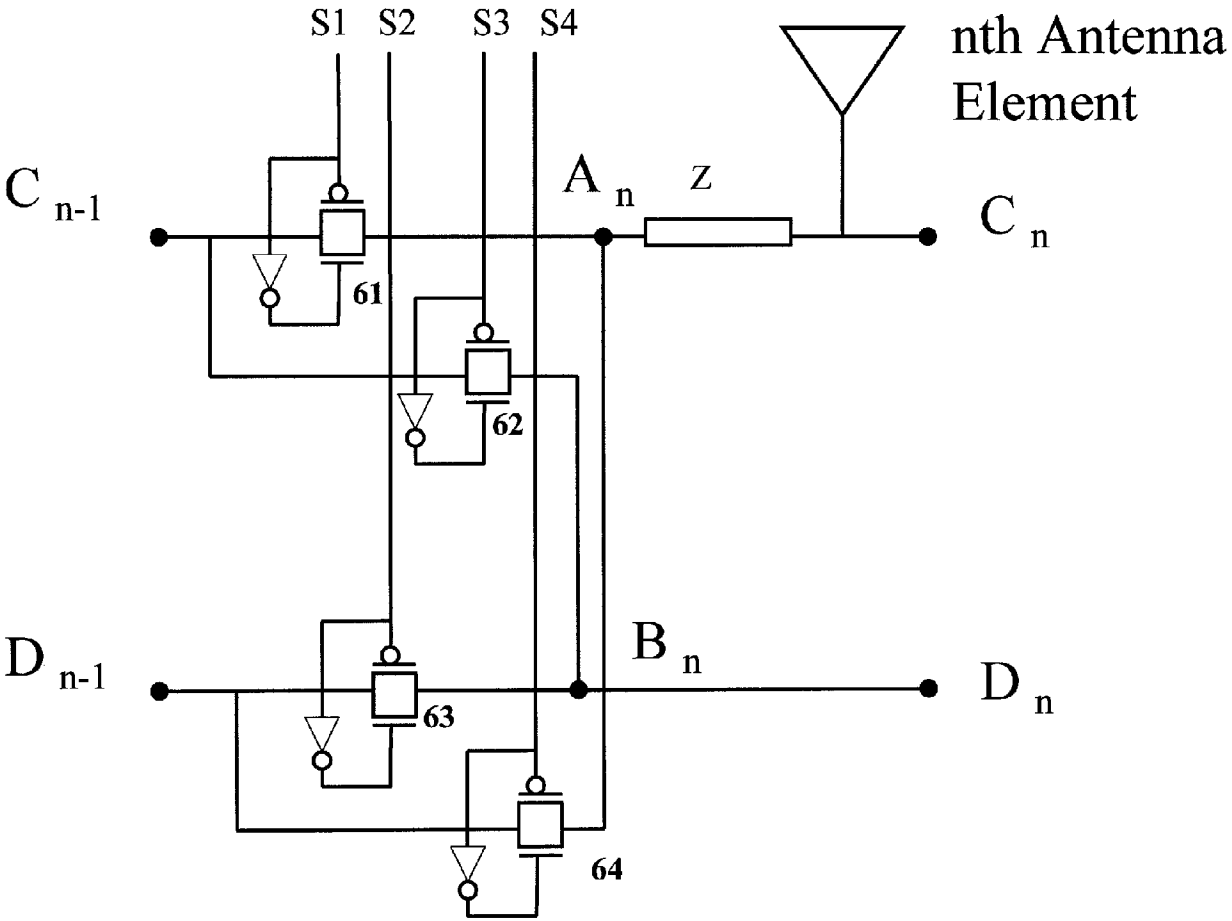
FIG. 4 is a schematic illustration of a transmission gate implementation for part of the switch matrix of FIG. 3*a*.

Each switch 305 may be implemented using CMOS transmission gates or other types of transistor switches. For example, a switch 305 of FIG. 4 includes four transmission gates G1 through G4 controlled by signals S1 through S4, respectively. The switch couples between input ports $A_n$ and $B_n$ for an nth antenna element and output ports $C_{n-1}$ and $D_{n-1}$ for an (n−1)th antenna element. Each transmission gate includes an inverter so as to be controllable through a single one of the control signals S1 through S4. For example, if signal S1 is brought low, output port $C_{n-1}$ will connect through input port $A_n$ and the matching impedance Z and the nth antenna element to output port $C_n$. At the same time, signals S2 through S4 are brought high so that transmission gates G2 through G4 are non-conducting. Alternatively, signal S3 may be brought low while the remaining signals S1, S2, and S4 are kept high to connect output port $C_{n-1}$ to input port B. As another alternative, only signal S2 is brought low so that output port $D_{n-1}$ connect to input port $A_n$. Finally, if only signal S4 is brought low, output port $D_{n-1}$ connects to input port $B_n$. In lieu of CMOS transmission gates, DMOS or JFET devices may be used to implement switches 305 so as to provide very low on-channel resistances. For example, should the LPDA include a relatively large number of dipoles such as thirty or more, the on-channel resistance of each switch should be an ohm or less.

To provide extended multi-band performance, multiple log periodic dipole arrays may be formed in the antenna layer. For example, a first LPDA may be configured to transmit and receive in the frequency band of 2 GHz to 7 GHz, a second LPDA may be configured to transmit and receive in the frequency band of 7 GHz to 18 GHz, and so on. In this fashion, a user may receive and/or transmit in a frequency band of, for example, 2 to 40 GHz.

The planar LPDA of FIG. 2 will need to be conformally transformed so as to integrate with a helmet. In that regard, the helmet shape may be assumed to be substantially hemispherical in a conventional reciprocal transformation (w=1/z) between a planar and a conformal LPDA. In such a mapping, each dipole translates to a concentric ring shape. The resulting ring-shaped dipoles are readily arrayed across the substantially-hemispherical surface of a helmet. Rather than assume a hemispherical shape, a more complex geometry may be used for the conformal mapping with a concomitant increase in mapping complexity. It is believed that a hemispherical model provides substantially the same performance, however, as the more complex geometrical models.

Figure 5:
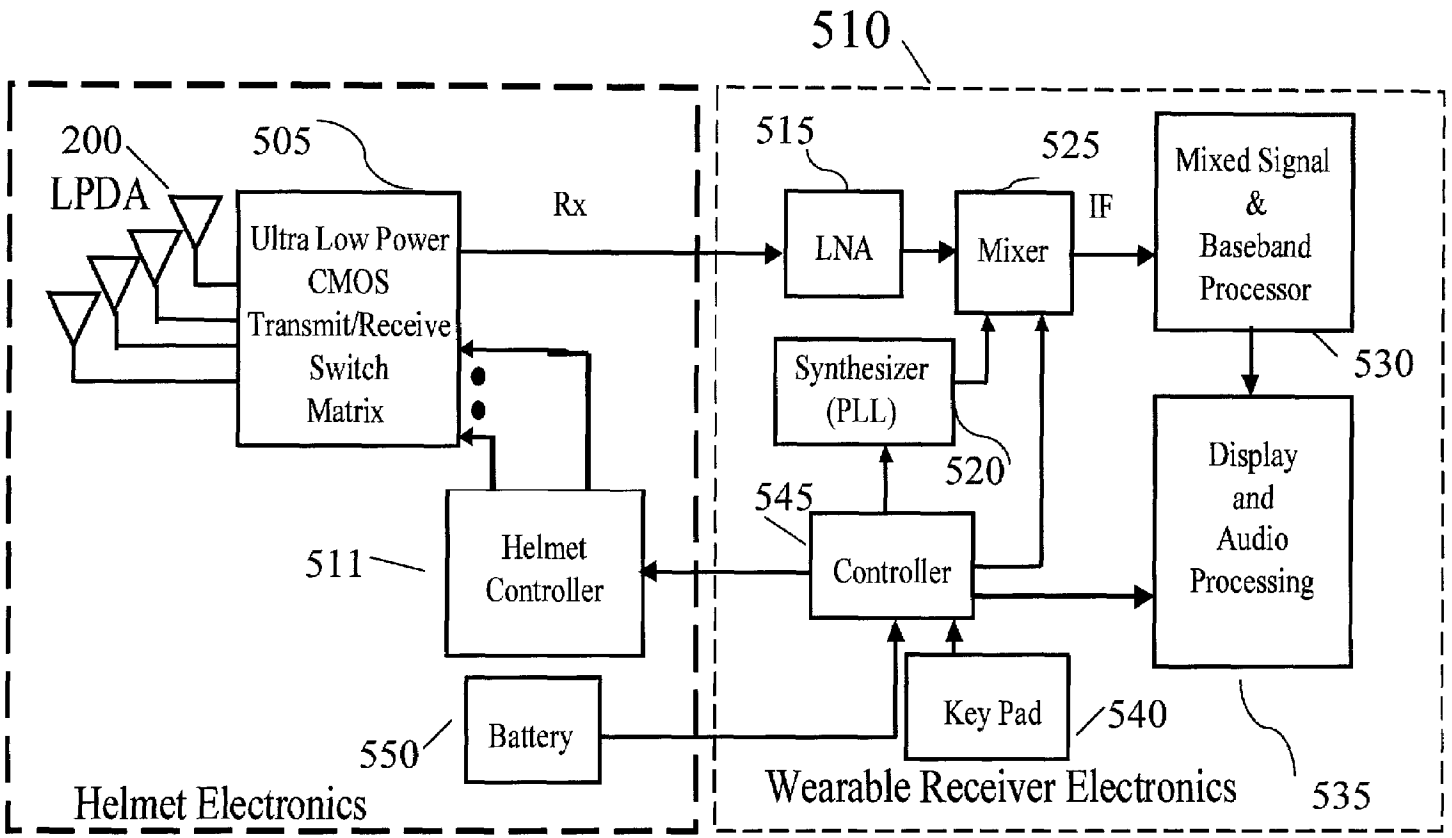
FIG. 5 is a block diagram of the helmet electronics and user-wearable receiver electronics for an exemplary HAAS.

A block diagram of the control electronics for a HAAS is illustrated in FIG. 5. The helmet electronics includes LPDA as well as a transmit/receive switch matrix 505 that includes the switches 305 discussed with regard to FIGS. 3*a*, 3*b*, and 4. A helmet controller 511 drives the switches with the control signals S such as discussed with regard to FIG. 4. The user includes a wearable receiver 510 that may include a low noise amplifier 515 to amplify the received RF signals from the LPDA, a frequency synthesizer such as a phase-locked loop (PLL) 520 for generating an local oscillator (LO) signal, and a mixer 525 for mixing the amplified RF with the LO to provide an IF signal. A baseband processor 530 processes the IF signal so that a user may hear or see the desired communication using a display and audio processing unit 535. The user may key in frequency parameters and other operating information using a keypad 540. A controller 545 responds to the user's input by configuring the remaining components accordingly. A battery 550 may be located in the helmet or in the receiver 510. Similarly, helmet controller 510 may be integrated into receiver controller 545.

Although the invention has been described with respect to particular embodiments, this description is only an example of the invention's application and should not be taken as a limitation. It will thus be obvious to those skilled in the art that various changes and modifications may be made without departing from this invention in its broader aspects. The appended claims encompass all such changes and modifications as fall within the true spirit and scope of this invention.

I claim:

1. A helmet antenna array system (HAAS), comprising:

a helmet having a metallic shield layer;

an RF absorptive layer on the metallic shield layer, an antenna layer over the RF absorptive layer, the antenna layer including a conformal log periodic dipole array having one end driven by an RF input signal and a remaining end forming a terminating node, the antenna layer further including an array of selectable switches corresponding to the dipoles such that each dipole in the array couples to adjacent dipoles through corresponding ones of the switches, and wherein each switch is selectable such that a corresponding one of the dipoles is isolated from the RF input signal or coupled to the RF input signal and wherein each switch includes two input ports and two output ports so that once a given dipole in the array is isolated, the RF signal is still driven from the one end to the remaining end; and a dielectric layer on the antenna layer.

2. The HAAS of claim 1, wherein the RF absorptive layer includes salt-water.

3. The HAAS of claim 1, wherein the metallic shield layer extends into a lip portion around a rim of the helmet.

4. The HAAS of claim 1, wherein each switch includes four transmission gates.

* * * * *